US007658613B1

(12) United States Patent
Griffin et al.

(10) Patent No.: US 7,658,613 B1
(45) Date of Patent: Feb. 9, 2010

(54) MAGNETIC CONNECTOR

(75) Inventors: Paul Griffin, Nashville, TN (US); David Reynolds, Mount Juliet, TN (US); Josh Sharpe-Stirewalt, Nashville, TN (US); Jack Jenkins, Antioch, TN (US); David A. Gilbert, Nashville, TN (US)

(73) Assignee: Griffin Technology Inc, Nashville, TN (US)

( * ) Notice: Subject to any disclaimer, the term of this patent is extended or adjusted under 35 U.S.C. 154(b) by 260 days.

(21) Appl. No.: 11/653,490

(22) Filed: Jan. 16, 2007

(51) Int. Cl.
*H01R 11/30* (2006.01)

(52) U.S. Cl. ..... 439/39

(58) Field of Classification Search ..... 439/38–39, 439/680, 40, 271, 289, 188
See application file for complete search history.

(56) References Cited

U.S. PATENT DOCUMENTS 5,954,520 A * 9/1999 Schmidt ..... 439/39
6,561,815 B1 * 5/2003 Schmidt ..... 439/38
6,821,126 B2 * 11/2004 Neidlein ..... 439/38
7,351,066 B2 * 4/2008 DiFonzo et al. ..... 439/39

* cited by examiner

*Primary Examiner*—Edwin A. Leon
(74) *Attorney, Agent, or Firm*—Hornkohl Intellectual Property, PLLC; Jason L. Hornkohl

(57) ABSTRACT

A connector uses complimentary magnetic arrays and mating surfaces on its plug and receptacle to facilitate connection and disconnection of the connector. The plug includes a magnetic array wherein the polarity of the magnets facing the receptacle when the plug and receptacle are connected is selected such that they can only be mated with a complimentary magnetic array on the receptacle when the plug has a desired orientation with respect to the receptacle. The plug and receptacle also have mechanical mating surfaces on their circumference that are shaped such that the plug and the receptacle can only be connected with the desired orientation. The plug can be separated from the receptacle by rotating the plug with respect to the receptacle such that the mechanical mating surfaces break the magnetic connection between the complimentary magnetic arrays.

21 Claims, 7 Drawing Sheets

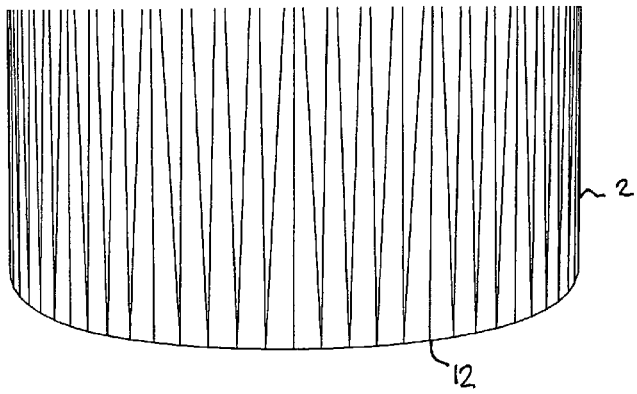
Fig 3
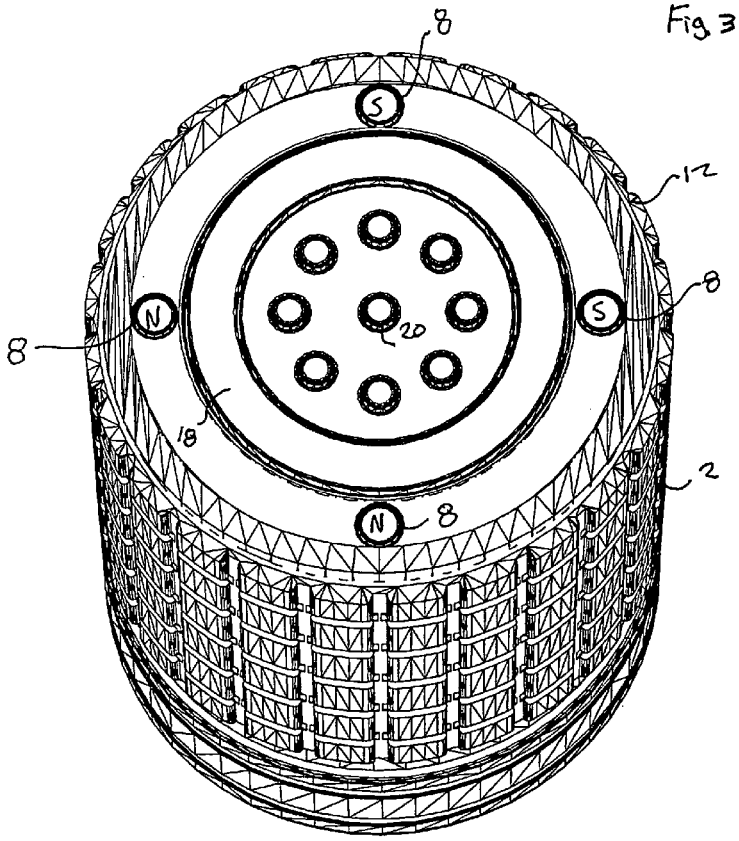

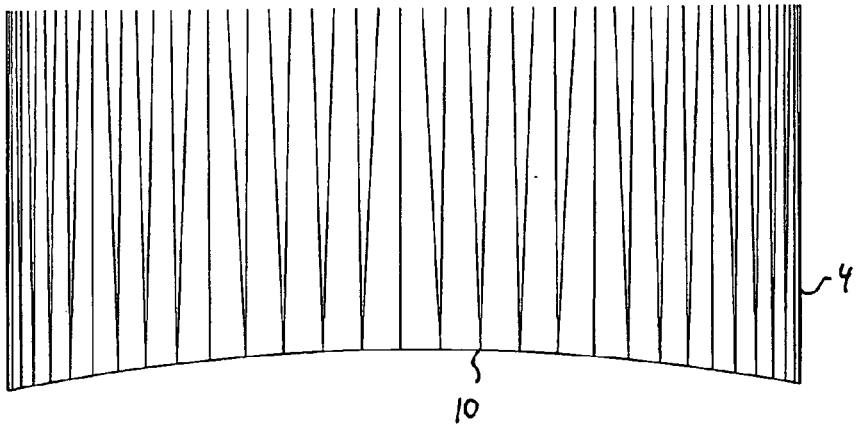
Fig. 4
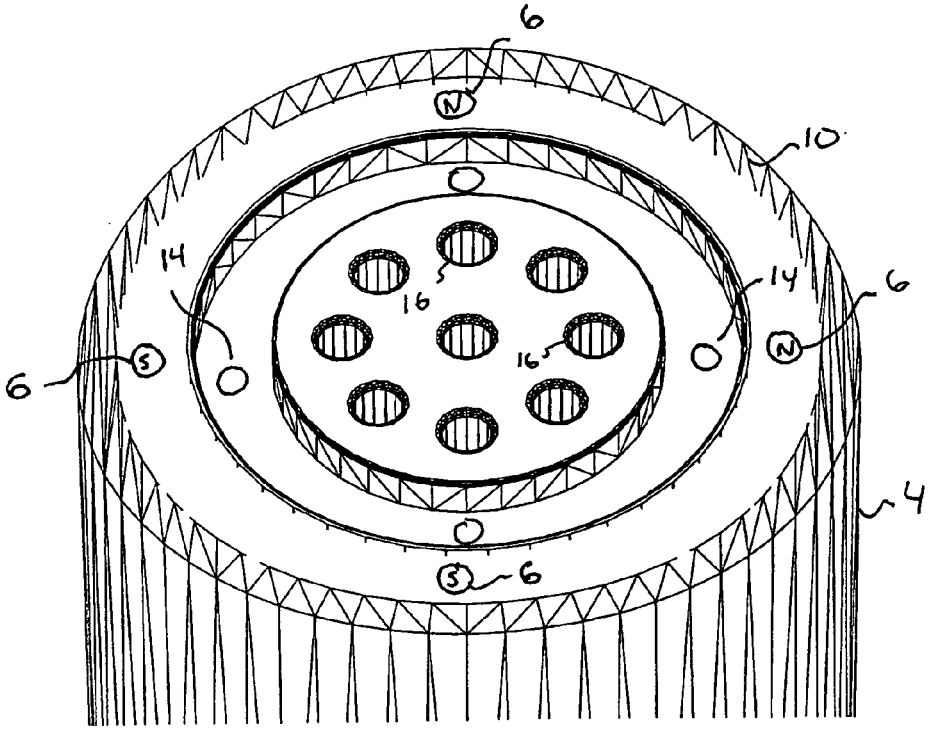

MAGNETIC CONNECTOR

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

FIELD OF THE INVENTION

The present invention is directed generally toward a magnetically coupled connector. More particularly, an embodiment of the present invention is directed toward a magnetic connector that uses magnetic and physical features to insure a proper plug to receptacle alignment or orientation when the connector is used.

BACKGROUND OF THE INVENTION

A wide variety of electrical connectors are known and used in the prior art. These connectors generally consist of a plug and a receptacle designed to receive the plug. The connectors typically use a mechanical or friction fit to couple the plug to the receptacle. Unfortunately, the connectors are sometimes inadvertently decoupled due to an accident such as when a person trips over a cable attached to the connector. These inadvertent decouplings can result in a broken connector or even damage to the connected electronic device such as by pulling a lap top computer off of a table and causing it to drop to the floor. If the plug is designed to be easily removed from the receptacle to prevent this type of damage, the plug may not maintain satisfactory electrical contact between the electrical contacts in the plug and the receptacle.

Another problem with prior art connectors is that uncoupling the plug from the receptacle often temporarily breaks the connections between some of the electrical contacts in the plug and receptacle while leaving other electrical contacts connected. This can lead to surge currents in the device when the plug is disconnected from the receptacle that may damage the electronics associated with the device. Therefore, what is needed is an improved connector.

BRIEF SUMMARY OF THE INVENTION

An embodiment of the present invention is directed toward a connector that includes a plug having a plug magnet and a plug face and a receptacle having a receptacle magnet and a receptacle face. The plug and receptacle magnets are positioned on the faces such that a magnetic polarity of the magnets urges the plug to mate with the receptacle such that the plug has with a predetermined orientation or alignment with respect to the receptacle. The magnets can also be arranged to urge the plug and receptacle to mate with one of two predetermined orientations if desired. The plug face and the receptacle face also have mating surfaces that are shaped such that the plug and receptacle can only be connected when the plug has the predetermined orientation or orientations with respect to the receptacle. Preferably, each of the mating surfaces has a raised portion that mates with a corresponding lowered portion of the opposing mating surface when the plug has the predetermined orientation with respect to the receptacle. The plug can be disconnected from the receptacle by rotating the plug with respect to the receptacle. A ground contact is positioned on the plug face and the receptacle face. The ground contact on the plug face is electrically connected to the ground contact on the receptacle face prior to an electrical connection being established between any other electrical contacts on the plug and receptacle faces when the plug is mated to the receptacle. The electrical connection between the ground contacts of the plug and the receptacle remains connected until all other electrical connections between the plug and the receptacle are broken when the plug and the receptacle are disconnected. Preferably, one of the ground contacts is a conductive ring and the other of the ground contacts is a biased ground pin.

Another embodiment of the present invention is directed toward an apparatus for establishing electrical connections between electrical contacts of a plug and electrical contacts of a receptacle. The apparatus includes at least one magnet positioned on the plug and at least magnet positioned on the receptacle. The magnets are positioned such that a magnetic polarity of the magnets forces the plug to mate with the receptacle such that the plug has a desired orientation with respect to the receptacle. The at least one magnet on the plug and the receptacle preferably include a circular array of magnets. The apparatus also has a mechanical feature that mates with a mechanical feature of the receptacle. The mechanical features force the plug to mate with the receptacle with the desired orientation with respect to the receptacle. The mechanical feature of the plug has raised portions and lowered portions positioned around a circumference of the plug that mate with corresponding raised and lower portions of the mechanical feature of the receptacle. One of the plug and the receptacle has a biased ground pin such that an electrical ground connection between the plug and the receptacle is established prior to an electrical connection being established between any of the electrical contacts in the plug and the electrical contacts in the receptacle when the plug is connected to the receptacle. The biased ground pin preferably mates with a grounding ring of the plug or receptacle.

Yet another embodiment of the present invention is directed toward a connector. The connector includes a first connector end having at least one magnet positioned on a mating surface thereof and a second connector end having at least one magnet positioned on mating surface thereof. The magnets are arranged such that a polarity of the magnets forces the first connector end to have a predetermined orientation with respect to the second connector end when the first and second connector ends are mated. A mating surface of the first connector end is shaped such that it can only mate with a mating surface of the second connector end when the first connector end has the predetermined orientation with respect to the second connector end. The first mating surface slopes between a high portion and a low portion such that the first connector end can be separated from the second connector end by rotating the first connector end with respect to the second connector end. The first connector end and the second connector end each have an electrical ground contact. The electrical ground contacts are electrically connected when the first connector end is mated to the second connector end prior to any other electrical contacts of the first connector end and the second connector end being electrically connected. One of the electrical ground contacts is preferably a spring biased pin and the other is a conductive ring. In a most preferred embodiment, one of the plug and the receptacle is mounted on a portable electronic device.

BRIEF DESCRIPTION OF THE SEVERAL VIEWS OF THE DRAWINGS

FIG. 3 is a close up illustration of the plug of the magnetically aligned connector of FIG. 2 constructed in accordance an embodiment of the present invention;

FIG. 4 is a close up illustration of the receptacle of the magnetically aligned connector of FIG. 2 constructed in accordance an embodiment of the present invention.

DETAILED DESCRIPTION OF THE INVENTION

Figure 1A:
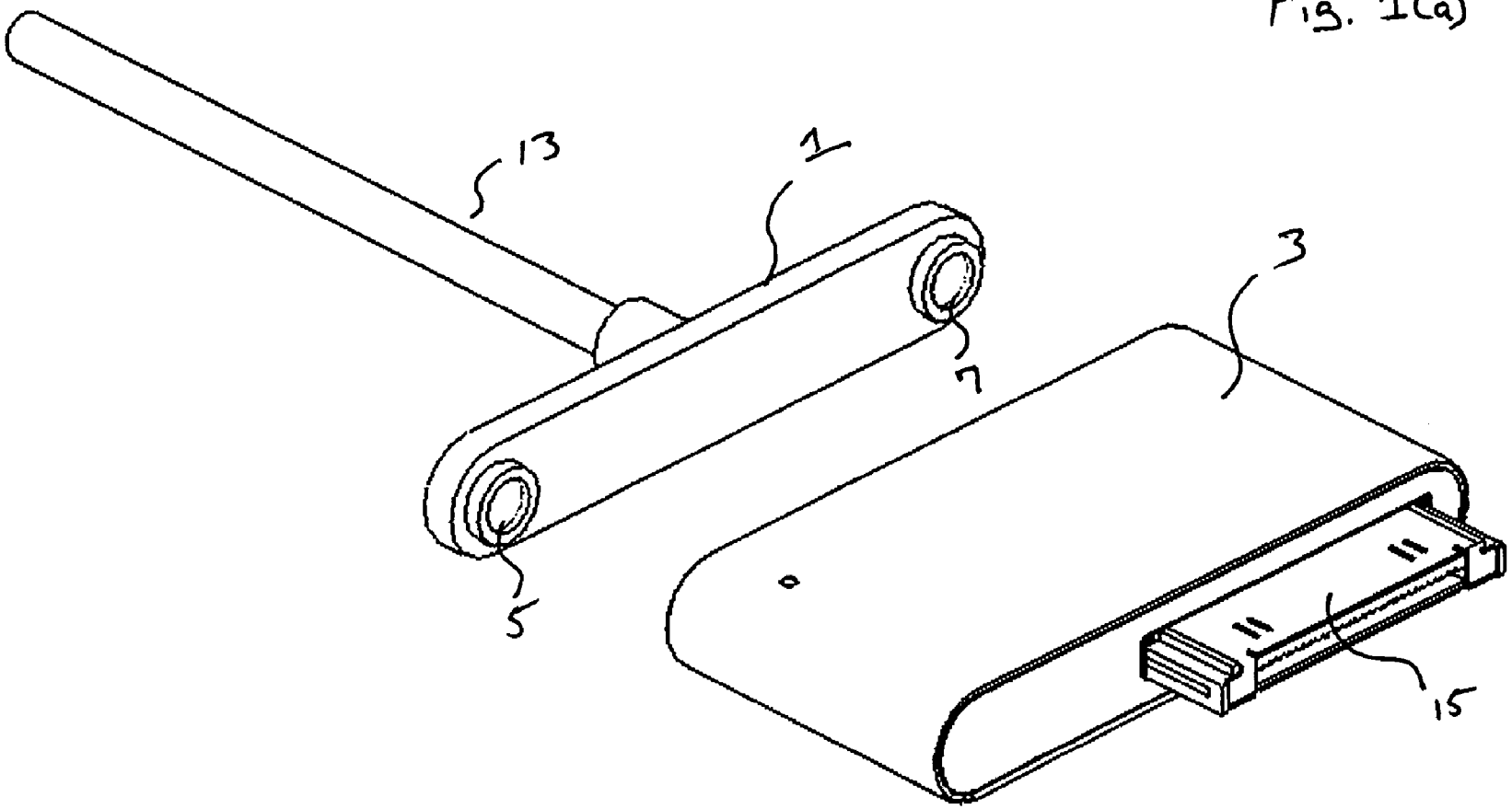
FIGS. 1(*a-c*) are illustrations of a plug and receptacle of a magnetically aligned connector constructed in accordance an embodiment of the present invention.
Figure 1B:
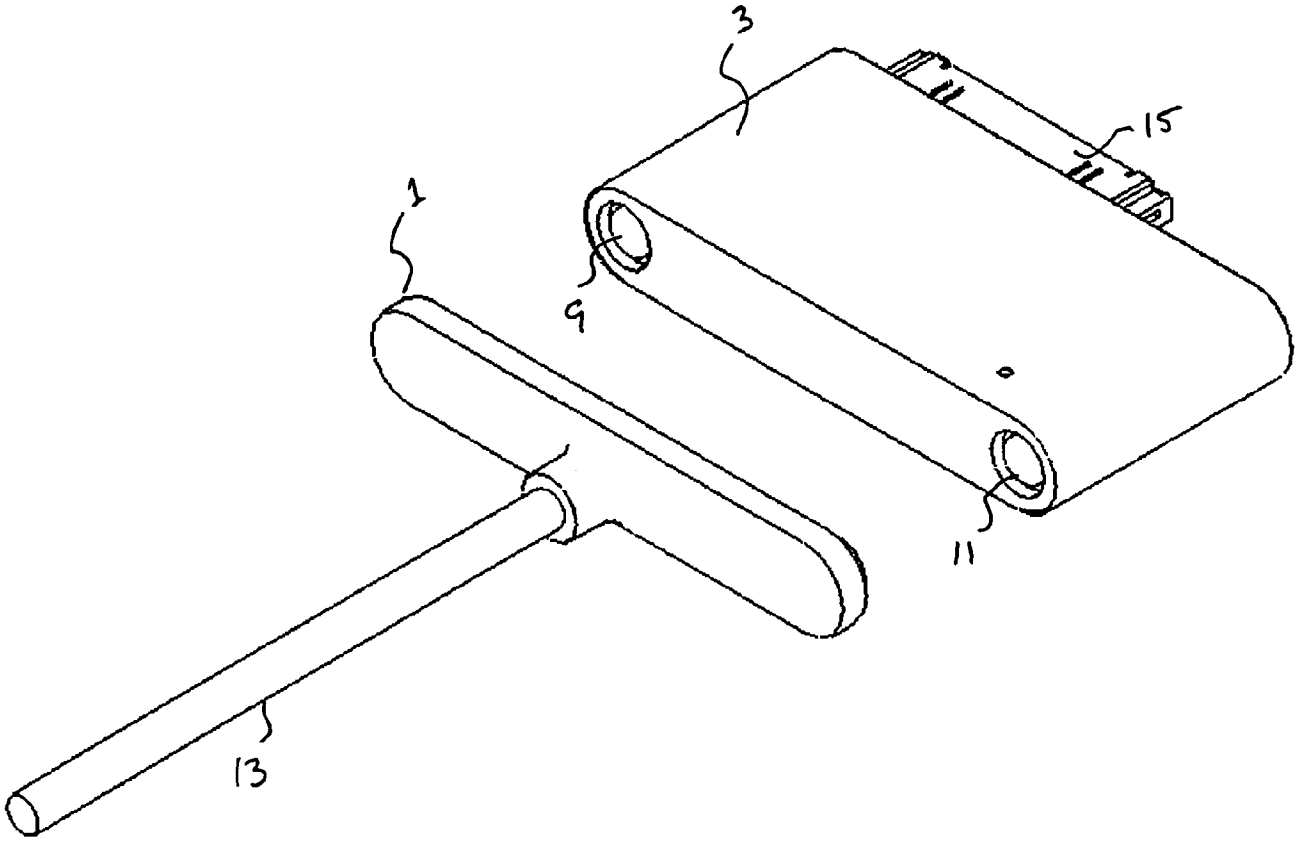
Figure 1:
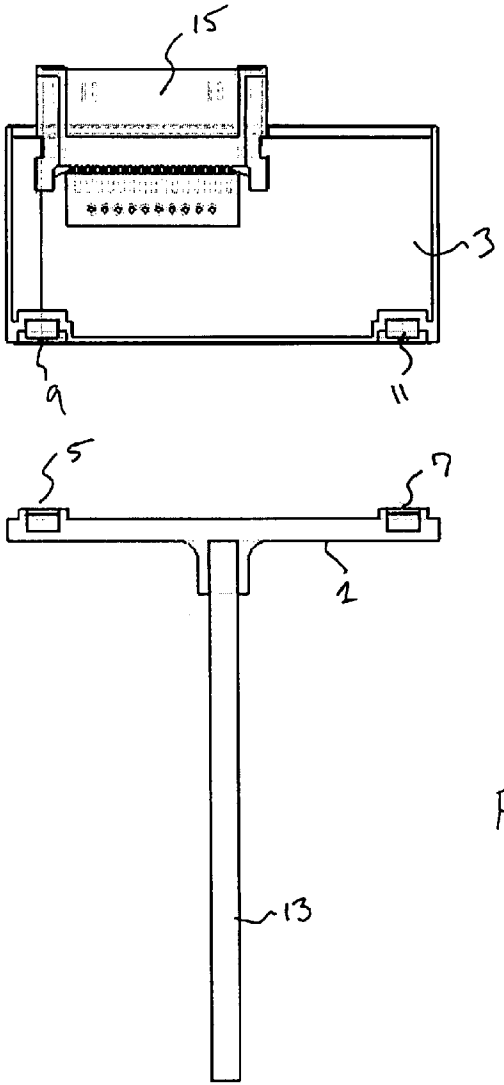

Referring now to FIGS. 1(*a-c*), a pair of mating connectors constructed in accordance with an embodiment of the present invention is shown. Each of the connector ends 1 and 3 has a pair of magnets 5, 7, 9 and 11, preferably Neodymium magnets, positioned thereon. The magnets are constructed such that the polarity of the magnets is aligned such that magnetic attraction between the magnets draws and holds the connector ends 1 and 3 together when the connector ends are properly aligned. The magnets 9 and 11 on one connector end 3 are recessed while the magnets 5 and 7 on the other end 1 protrude to provide a limited physical connection as well as a magnetic connection when the connector ends 1 and 3 are properly aligned and coupled. In addition, in the embodiments of FIGS. 1(*a*)-(*c*), the magnets are electrically connected to conductors in the cable 13 and connector 15. These electrical connections allow electrical signals and power to be transferred from a device coupled to the connector 15 and the cable 13. For example, if the other end of the cable 15 is connected to a power supply and the connector 13 is coupled to a portable electronic device such as a digital media player, the magnetic connections can be used to transfer power for charging the portable electronic device from the power supply. However, the magnetic connection between the magnets 5, 7, 9 and 11 can be more easily, quickly and safely broken than the physical connection between the connector 13 and the portable electronic device. Thus, if the cord is pulled on, the device or connector 13 will not be damaged. While two magnetic connections are shown in FIGS. 1(*a-c*) for exemplary purposes, any number of connections could be made. The polarity of the magnets will simply be alternated individually or in groups such that the connectors will attract when properly aligned. In addition, physical features may be used to further facilitate proper alignment as described below. Also, while the conductivity of the magnets is generally sufficient for data transmission, the magnets may be coated with a conductive material to improve their conductivity if desired.

Figure 2:
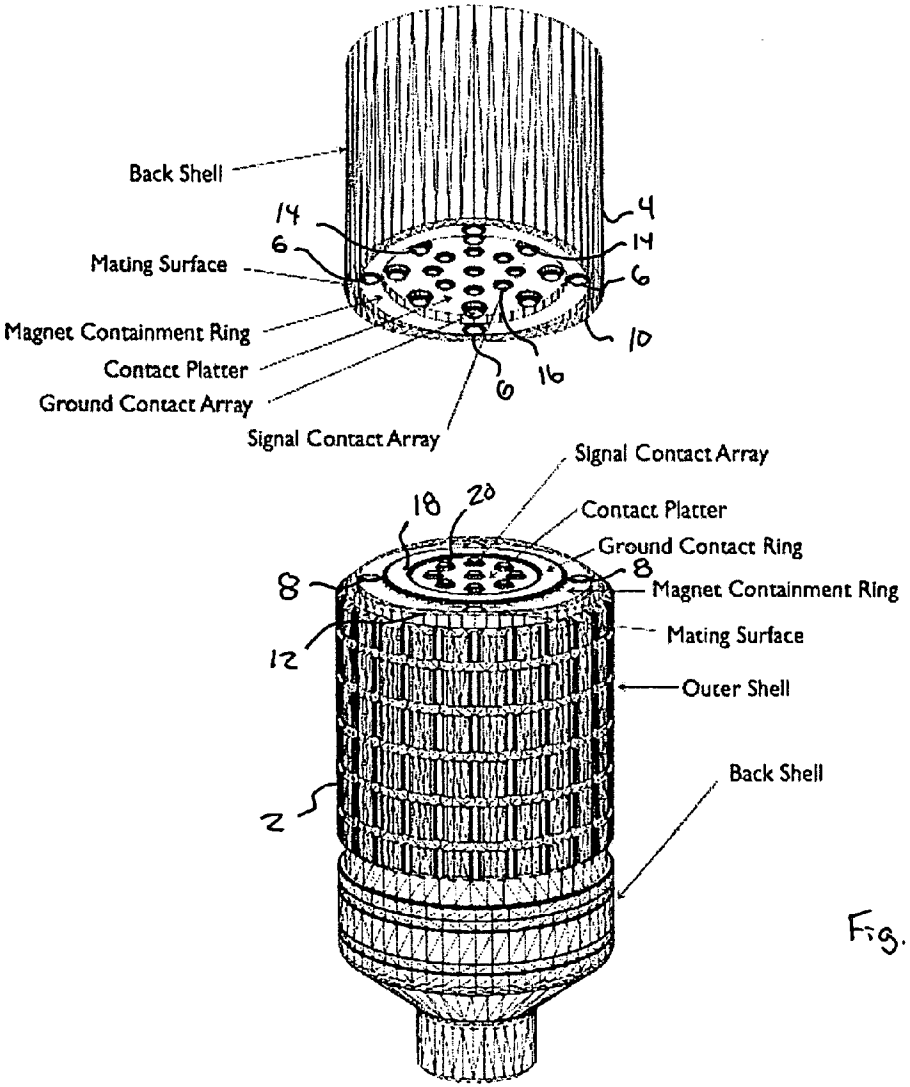
FIG. 2 is an illustration of a plug and receptacle of a magnetically aligned connector constructed in accordance with another embodiment of the present invention.

Another embodiment of the present invention is directed toward an alignment and engagement device that couples two given bodies at a specific orientation through use of (1) strategically positioned and polarized magnet arrays, and (2) complementarily shaped mating surfaces. Referring now to FIG. 2, the connector consists of a plug 2 and receptacle 4, each containing an array of magnets 6 and 8 that coerce the plug 2 and receptacle 4 into a preferred orientation when they are in close proximity, and a series of mechanical features 10 and 12 that coerce the plug 2 and receptacle 4 into a specific orientation when they are touching. Once the plug 2 and receptacle 4 are coupled in the proper orientation, a magnetic bond between the magnetic arrays 6 and 8 of the plug 2 and receptacle 4 sustains the engagement between the plug 2 and receptacle 4. FIG. 3 is a close up view of the plug of FIG. 2 more clearly showing the mating surface 12 and FIG. 4 is a close up view of the receptacle of FIG. 2 showing the mating surface 10.

The magnets in the magnetic arrays 6 and 8 are preferably cylindrical magnets that have a "north" polarity on one end face and a "south" magnetic polarity on the other face. The magnets are arranged in the arrays 6 and 8 such that when the plug 2 is properly oriented with respect to the receptacle 4, the magnets in the receptacle array 6 align with magnets of opposite polarity in the magnetic array 8 of the plug 2 thereby holding the plug 2 firmly against the receptacle 4. Conversely, when a user guides the plug 2 towards the receptacle 4 at an unfavorable magnetic polar orientation, the magnet arrays 6 and 8 exert forces of magnetic repulsion that the user can circumvent by rotating the plug 2 several degrees in either a clockwise or counterclockwise direction such that the opposite polarity magnets in the magnetic arrays 6 and 8 are properly aligned. When the magnetic array 8 on the plug 2 encounters a favorable polar orientation with respect to the magnetic array 6 on the receptacle 4, the magnetic forces of attraction pull the plug 2 towards the receptacle 4. As the plug 2 and receptacle 4 are drawn closer together, the mechanical mating surfaces 10 and 12 of plug 2 and receptacle 4 make contact, at which point the user is able to release the plug 2 and allow the combination of magnetic attraction and mechanical guidance to couple the connector with a specific, desired orientation. Thus, a connector constructed in accordance with an embodiment of the present invention is easier to properly connect than prior art connectors.

A connector constructed in accordance with an embodiment of the present invention is also easier to disconnect than prior art connectors. The plug 2 can be disconnected from the receptacle 4 by simply rotating the plug 2 in either a clockwise or counterclockwise direction. The effect of this rotation is twofold. First, due to the complementary shapes of the plug and receptacle's respective mating surfaces 10 and 12, rotating the plug 2 will cause the protruding edge of the plug to move towards the leading edge of the receptacle 4. This movement will increase the distance between plug 2 and receptacle 4, thereby diminishing the magnetic bond between the magnetic arrays 6 and 8 positioned thereon. Secondly, due to the strategic polarization of their respective magnet arrays 6 and 8, rotating the plug 2 will cause the magnets of the plug to move out of a favorable polar orientation with the magnets of the receptacle 4. This movement will cause the magnets 6 and 8 of plug 2 and receptacle 4 to repulse each other, thereby leading to disengagement of the connector ends. Thus, the coincidence of the mechanical separation of, and the magnetic disorientation of, the plug 2 and receptacle 4 allow for a graceful and effortless disengagement of the connector. Alternatively, the plug can be pulled straight back from the receptacle by a user applying sufficient force to simply overcome the magnetic attraction between the magnets 6 and 8.

An embodiment of the present invention directed toward a magnetic and mechanical engagement device for a wired electrical connector provides a number of advantages. A wired electrical connector, such as a USB (Universal Serial Bus) connector, consists of a plug and receptacle that connect to each other in a specific orientation. To prevent damaging currents, pins that communicate data, power, and ground, must connect to each other in a certain sequence. For example, in the case of a USB connector, the ground pins must be the first to connect and the last to disconnect. Previously, the shape of wired electrical connectors has been constrained by this necessity. However, embodiments of the present invention provide for a wired electrical connector that can be coupled and decoupled much more easily than prior art connectors. More particularly, embodiments of the present invention allow the plug to be disconnected from the receptacle at any angle without damaging the electrical circuits of the serial bus. This is accomplished by ensuring that, regardless of the angle of decoupling, the ground pins of the connector will always be the last pins to disconnect. The order in which the pins disconnect is determined by the arrangement and height of the ground pins 14 on the receptacle 4 in relation to a ground contact ring 18 on the plug 2. Taller, spring-loaded, ground pins 14 on the contact platter of the receptacle circumscribe shorter data pins 16. These ground pins 14 make contact with a ground contact ring 18 on the plug 2 that circumscribes a contact platter of data pins 20. At any angle of decoupling, the last pin to disconnect will necessarily be one of the taller, spring-loaded, ground pins 14 on the contact platter of the receptacle 4.

Embodiments of the present invention also prevent damage to associated electronic devices by insuring that the magnetically coupled connector will decouple when subjected to a force that exceeds the magnetic attraction of the connector. Sometimes cable connectors are inadvertently decoupled when a person trips over the associated cable. This often leads to a broken connector and possibly even to damage to the connected electronic device (e.g., by pulling the device off of a table and causing it to drop to the floor). Because embodiments of the present invention utilize a magnetic connection, they allow for the connector to decouple when a sudden force is applied without resulting in any damage to the connector or the associated electronic device.

Figure 5:
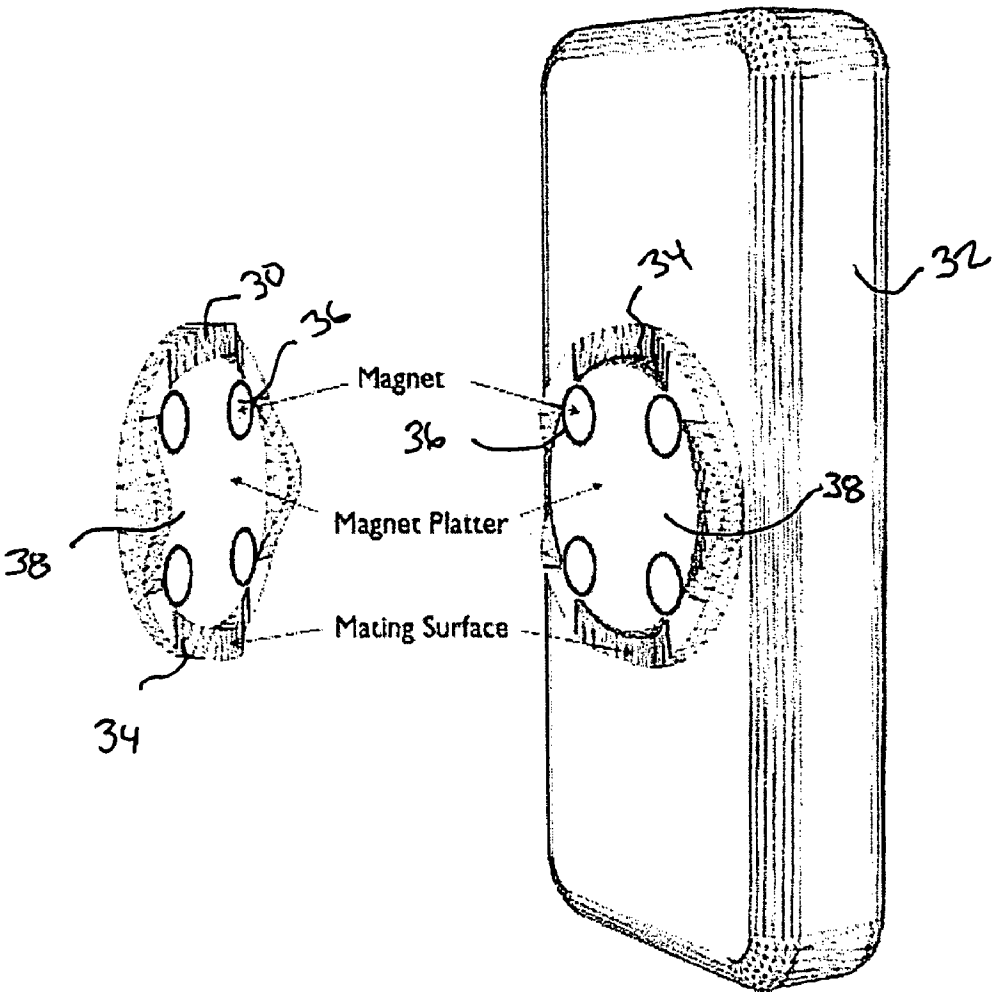
FIG. 5 is an illustration of a magnetically aligned connector for use with a portable media player constructed in accordance an embodiment of the present invention.

Referring now to FIG. 5 an embodiment of the present invention used to secure a remote control 30 to a portable electronic device 32 is shown. The details of the device 32 and the remote 30 are beyond the scope of the present invention and omitted for clarity. Complimentary mating surfaces 34 are positioned on the device 32 and the remote 30. In addition, complimentary magnetic arrays 36 are positioned on a magnetic platter 38 of the device 32 and the remote 30. Thus, the remote 30 can be attached to the device 32 merely by placing the remote 30 in close proximity to the mating surface 34 of the device 32. The remote 30 will then rotate to correctly orient itself on the face of the device 32. Furthermore, the remote 30 can be removed from the device 32 by simply twisting the remote 30 with respect to the device 32 and thereby causing the mating surfaces 34 and magnetic arrays 36 to interact and disconnect the remote 30 from the device 32. Also, if a shock force is applied to the remote 30 or the device 32, the remote 30 will simply separate from the device 32 with damaging any connecting components. Thus, the present invention can be used to connect any two devices or components desired, with or without establishing an electrical connection. Therefore, the present invention represents a substantial improvement upon the prior art.

The magnets discussed herein may be permanent or electric/electromagnets. In embodiments using electric magnets, the magnets can be turned off or switch polarity such that the connector will disconnect upon the occurrence of an event. This triggering event could be the completion of a charging cycle or because of detected compatibility or authorization problems. The magnets may also deactivate when the power is removed such that the connection automatically is broken. The device may also sense the connections and then alter the magnets polarity accordingly to either enable or disable the connection.

The magnets discussed herein may also be covered with a conductive coating to improve the electrical connections between aligned magnets in embodiments that communicate or transfer signals through the magnets. Preferably, the magnets are coated with nickel.

In accordance with an alternative embodiment of the present invention, the magnetic connectors of the present invention may also be incorporated into portable device cases to provide external access to the electrical contacts of the device concealed within the case. The connectors are beneficial in such a situation in that they can provide airtight access to the contacts of the device contained within the case while also providing all of the above discussed alignment and disconnection benefits of the magnetically aligned connector contacts discussed herein.

Although there have been described particular embodiments of the present invention of a new and useful MAGNETIC CONNECTOR herein, it is not intended that such references be construed as limitations upon the scope of this invention except as set forth in the following claims.

What is claimed is:

1. A connector having a first and second connector end, said connector comprising:

a plurality of magnets positioned on said first and second connector ends wherein said magnets are positioned on said connector such that when said connector ends are properly aligned a polarity of said magnets urges said connector ends into a predetermined orientation; and a ground contact positioned on said first connector end and said second connector end wherein said ground contact on said first connector end is electrically connected to said around contact on said second connector end prior to an electrical connection being established between any other electrical contacts on said first and second connector ends when said first and second connector ends are connected.

2. The connector of claim 1 wherein electrical signals are transferred between said connector ends through at least a portion of said plurality of magnets.

3. The connector of claim 1 wherein at least a portion of said magnets are electric magnets that can be selectively turned on or off.

4. The connector of claim 1 wherein at least a portion of said magnets are electric magnets and wherein a polarity of said electric magnets can be selectively altered.

5. A connector comprising:

a plug having a plug magnet and a plug face;

a receptacle having a receptacle magnet and a receptacle face; and a ground contact positioned on said plug face and said receptacle face wherein said ground contact on said plug face is electrically connected to said ground contact on said receptacle face prior to an electrical connection being established between any other electrical contacts on said plug and receptacle faces when said plug is mated to said receptacle and wherein an electrical connection between said ground contacts of said plug and said receptacle remains connected until all other electrical connections between said plug and said receptacle are broken when said plug and said receptacle are disconnected;

wherein said plug and receptacle magnets and are positioned on said faces such that a magnetic polarity of said magnets urges said plug to mate with said receptacle such that said plug has with a predetermined orientation with respect to said receptacle.

6. The connector of claim 5 wherein said plug face and said receptacle face further comprise mating surfaces that are shaped such that said plug and receptacle can only be connected when said plug has said predetermined orientation with respect to said receptacle.

7. The connector of claim 5 wherein one of said ground contacts is a conductive ring and the other of said ground contacts is a biased ground pin.

8. The connector of claim 5 wherein said magnets urge said plug and receptacle to mate with one of two predetermined orientations.

9. The connector of claim 6 wherein each of said mating surfaces has a raised portion that mates with a corresponding lowered portion of said opposing mating surface when said plug has said predetermined orientation with respect to said receptacle.

10. The connector of claim 9 wherein said plug can be disconnected from said receptacle by rotating said plug with respect to said receptacle.

11. An apparatus for establishing electrical connections between electrical contacts of a plug and electrical contacts of a receptacle, said apparatus comprising:

at least one magnet positioned on said plug and at least one magnet positioned on said receptacle wherein said magnets are positioned such that a magnetic polarity of said magnets forces said plug to mate with said receptacle such that said plug has a desired orientation with respect to said receptacle;

wherein one of said plug and said receptacle has a biased ground pin such that an electrical ground connection between said plug and said receptacle is established prior to an electrical connection being established between any of said electrical contacts in said plug and said electrical contacts in said receptacle when said plug is connected to said receptacle.

12. The apparatus of claim 11 wherein said biased ground pin mates with a grounding ring.

13. The apparatus of claim 11 wherein said at least one magnet on said plug and said receptacle further comprise a circular array of magnets.

14. The apparatus of claim 11 wherein said plug further comprises a mechanical feature that mates with a mechanical feature of said receptacle and wherein said mechanical features force said plug to mate with said receptacle with said desired orientation with respect to said receptacle.

15. The apparatus of claim 14 wherein said mechanical feature of said plug further comprises raised portions and lower portions positioned around a circumference of said plug that mate with corresponding raised and lower portions of said mechanical feature of said receptacle.

16. A connector comprising:

a first connector end having at least one magnet positioned on a mating surface thereof; and a second connector end having at least one magnet positioned on mating surface thereof;

wherein said magnets are arranged such that a polarity of said magnets forces said first connector end to have predetermined orientation with respect to said second connector end when said first and second connector ends are mated; and wherein said first connector end and said second connector end each further comprise an electrical ground contact and wherein said electrical ground contacts are electrically connected when said first connector end is mated to said second connector end prior to any other electrical contacts of said first connector end and said second connector end being electrically connected.

17. The connector of claim 16 wherein one of said electrical ground contacts is a spring biased pin and the other is a conductive ring.

18. The connector of claim 16 wherein one of said plug and said receptacle is mounted on a portable electronic device.

19. The connector of claim 16 wherein said magnets further comprise circular arrays of magnets.

20. The connector of claim 16 wherein a mating surface of said first connector end is shaped such that it can only mate with a mating surface of said second connector end when said first connector end has said predetermined orientation with respect to said second connector end.

21. The connector of claim 20 wherein said first mating surface slopes between a high portion and a low portion such that said first connector end can be separated from said second connector end by rotating said first connector end with respect to said second connector end.

* * * * *